United States Patent [19]

Litzenberger

[11] Patent Number: 4,844,975

[45] Date of Patent: Jul. 4, 1989

[54] REINFORCED COMPOSITE SANDWICH PANEL ASSEMBLY

[75] Inventor: Ernest N. Litzenberger, Boyertown, Pa.

[73] Assignee: Bally Engineered Structures, Inc., Bally, Pa.

[21] Appl. No.: 164,382

[22] Filed: Mar. 4, 1988

[51] Int. Cl.[4] ..... B32B 3/06; E04B 1/74

[52] U.S. Cl. ..... 428/306.6; 428/138; 428/308.4; 428/309.9; 428/317.5; 428/317.9; 52/404; 52/732; 52/807

[58] Field of Search ..... 428/138, 306.6, 308.4, 428/309.9, 317.5, 317.9; 52/404–407, 807, 932

[56] References Cited

U.S. PATENT DOCUMENTS

| | | | |
|---|---|---|---|
| 2,116,020 | 5/1938 | Gauvin | 52/807 |
| 2,151,220 | 3/1939 | Mattes | 428/306.6 |
| 3,194,708 | 7/1965 | Fourcade et al. | 428/308.4 |
| 3,344,574 | 10/1967 | Palfey | 52/404 |
| 3,353,314 | 11/1967 | Melcher | 52/127 |
| 3,472,728 | 10/1969 | Hitch | 161/69 |
| 3,496,692 | 2/1970 | Melcher | 52/583 |
| 3,591,444 | 7/1971 | Hoppe | 428/308.4 |
| 3,611,653 | 10/1971 | Zinn | 52/407 |
| 3,707,433 | 12/1972 | Clough et al. | 428/309.9 |
| 4,091,142 | 5/1978 | Elmore et al. | 428/309.9 |
| 4,327,142 | 4/1982 | Norzi | 428/308.4 |
| 4,425,396 | 1/1984 | Hartman | 428/220 |
| 4,471,591 | 9/1984 | Jamison | 52/404 |
| 4,571,909 | 2/1986 | Berghuis et al. | 52/404 |
| 4,575,886 | 3/1986 | Larson | 5/450 |
| 4,671,032 | 6/1987 | Reynolds | 52/807 |
| 4,753,837 | 6/1988 | Hanusa | 428/86 |

FOREIGN PATENT DOCUMENTS

| | | | |
|---|---|---|---|
| 2554387 | 5/1985 | France | 428/309.9 |

OTHER PUBLICATIONS

Bondin, Lightweight Insulated Sandwich Elements with Polyurethane Adhesive, Sadofoss et al, Adhesion Age, Jun. 1977, pp. 23–28.

*Primary Examiner*—Ellis P. Robinson
*Assistant Examiner*—P. J. Ryan
*Attorney, Agent, or Firm*—James C. Valentine

[57] ABSTRACT

A composite panel assembly for walk-in coolers and freezers and similar structures has a thickness of low strength insulation sandwiched between two facings. A reinforcing structural member is bonded to the insulation side of one of the facings and extends across at least about half of the thickness of the insulation but is spaced from the opposite facing. The reinforcing member does not provide a direct thermal path between facings; thus preventing condensation on the facing during high humidity and/or low temperature conditions.

9 Claims, 1 Drawing Sheet

REINFORCED COMPOSITE SANDWICH PANEL ASSEMBLY

This invention relates to improvements in composite sandwich panel assemblies which may be connected together to form walls, floors and ceilings of walk-in coolers, freezers, refrigerated buildings, record storage rooms, equipment shelters and controlled atmosphere buildings. More particularly, this invention relates to assemblies having internal members for reinforcing such structures. See, e.g., U.S. Pat. Nos. 3,353,314 and 3,496,692 to Melcher ("Melcher Patents") and U.S. Pat. No. 3,472,728 to Hitch ("Hitch Patent") which disclose conventional sandwich panels and structures formed from them.

As is disclosed by the Melcher and Hitch Patents, sandwich panel assemblies generally comprise a relatively thick insulating material having low mechanical strength bonded with two facings. The insulating material is typically foamed-in-place polyurethane or other suitable thermal insulating material. The facings are typically thin metal skins made of galvanized or stainless steel or aluminum. Other facings such as wood, gypsum or composites may be used in place of metal. As is further disclosed, these assemblies may also have internal reinforcing members in contact with both facings to provide structural support.

Internal structural members undesirably provide a direct thermal path between the facings. Heat transfer into a refrigerated interior or controlled atmosphere of a structure is necessarily designed into the structure. In some applications the heat gain is an acceptable tradeoff. The Hitch Patent, for example, states that there is "no appreciable sacrifice in the insulative quality of the floor" of the disclosed invention. Another problem in some applications is cold flow to the outside environment. This causes the condensation of moisture on the outside facing of a refrigerated structure during high humidity or low temperature conditions. This results in unsightly condensation lines on the outer facings of the assemblies.

The sandwich panel assembly of the present invention has internal structural members for reinforcing the panel assembly without providing a direct thermally conductive path between the facings. The assembly has a thickness of thermal insulation between two facings and at least one reinforcing member having a side bonded to the insulated side of one of the facings. The reinforcing member extends through at least about half of the thickness of the insulation toward the second facing but is spaced from it. Preferably the member is continuously bonded adhesively to the facing to provide an insulating layer between the member and the facing. Thus, there is no thermal short circuiting across the member to the spaced apart facing. An apertured reinforcing member facilitates the assembly process and provides a lighter member having lower cold transfer between facings.

Other details, objects and advantages of the invention will become apparent as the following description of a presently preferred embodiment thereof proceeds.

In the accompanying drawings a presently preferred embodiment of the invention is shown in which:

FIG. 1 is a schematic representation of the composite sandwich panel assemblies disclosed by the Melcher Patents (which are incorporated by reference for their structural disclosures) and the types of buildings and rooms which may be constructed from them.

Figure 1:
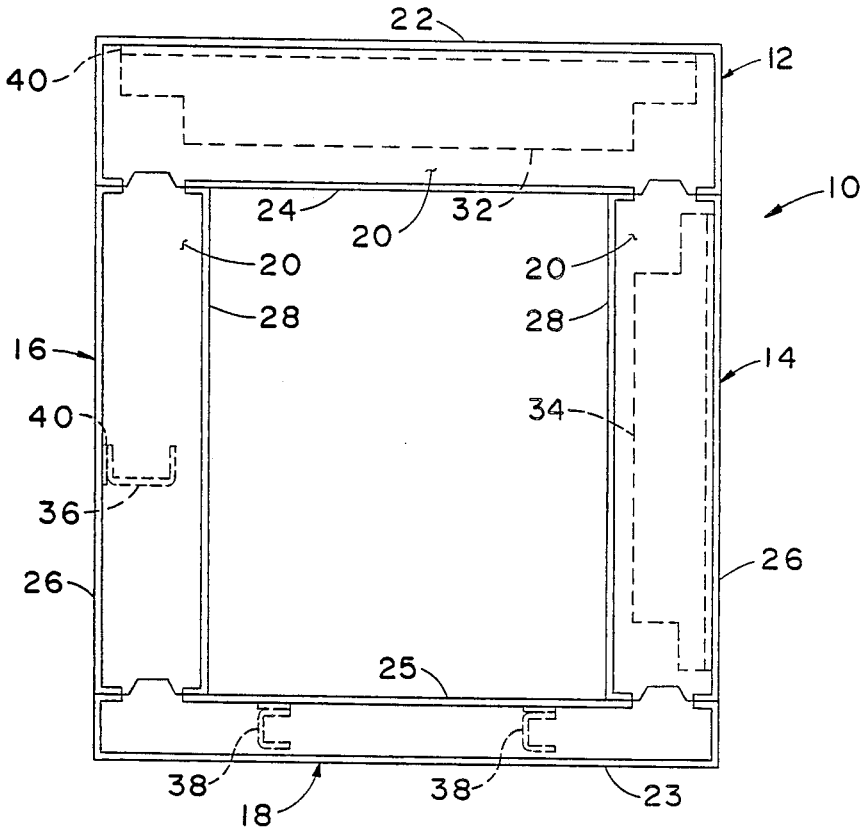
FIG. 1 is a schematic front view of a structure employing the present invention.

FIG. 1 generally depicts an insulated structure 10 comprising a roof member 12 and supporting wall members 14, 16 on a floor member 18. Such a structure 10 would also have similar front and rear wall members, which are not shown. Each member 12, 14, 16, 18 comprises one or more composite sandwich panel assemblies which are connected together and with an underlying subfloor (not shown) as disclosed by the Melcher Patents or by conventional screws or bolts. Further, each member 12, 14, 16, 18 is a composite sandwich of a thickness of insulating material such as foamed-in-place polyurethane 20, which has a K factor of 0.14 Btu/(hr)(ft$^2$)(°F.)/(in), disposed between two facings. Such panel assemblies are commercially available in standard sizes. Large panel assemblies are available from the assignee of the present invention in sizes of up to about eighteen feet in length by about four feet in width with facings of about 0.026 inch thick steel or about 0.042 inch thick aluminum. The spacing between the facings depends on the thermal design specifications. For example, panel assemblies for maintaining a room temperature of minus 10° F. with an ambient temperature of 90° F. may have nominal thicknesses of about 5 inches or more. The roof and floor member 12, 18 each have an upper facing 22, 23 respectively which tends to compress the assembly and a lower facing 24, 25 respectively which tends to exert a tensile force on the assembly. The side members 14, 16 each have an outer facing 26 and an inner facing 28. There may be tongue and groove joints between members 12, 14, 16, 18 as shown or, alternatively, flush joints.

The panel assemblies of members 12, 14, 16 and 18 have reinforcing members such as purlins 32, 34, 36 and 38, 38 respectively. The purlins of each assembly are bonded to the facing having the highest design load. Also, each facing of an assembly may have one or more purlins bonded to it in extreme design specifications. As is shown in FIG. 1, the purlins do not extend from facing to facing. Rather they extend at least about half of the thickness of the insulation and are spaced from the opposite facing with the insulation 20 filling the space. For example, a five inch thick assembly preferably has about a one inch spacing between the purlin(s) bonded to one facing and the opposite facing. Thus the reinforcing members 32, 34, 36, 38, 38 do not present a direct thermal path between opposing facings 22, 24 and 26, 28 and 23, 25 respectively. Most preferably the purlins are bonded to the facings by an adhesive which forms an insulating layer 40 between the purlins and the facings for further restricting cold transfer. Typically, an adhesive layer having a thickness of about 0.03 inches would have a K factor of about 0.18 Btu/(hr)(ft$^2$)(°F.)/(in) and a steel purlin would have a K factor of about 312 Btu/(hr)(ft$^2$)(°F.)/(in). In addition, the ends of the purlins may be cut back as shown in the drawings so that cold transfer near the joints is restricted.

The purlins 32, 34, 36, 38, 38 extend at least about half the length of the facings to which they are bonded and, most preferably, at least ninety percent of the length of the facings for reinforcing the assemblies. Most preferably the purlins do not contact the ends of the facings of the members 12, 14, 16 18, but extend to within about $\frac{3}{4}$ inch of the ends of the members to restrict cold transfer.

As shown, the purlin 32 of the roof member 12 may be bonded to the compression facing 22. The purlin 32 stiffins the facing 22 by extending the compression ripple buckling failure load and thus avoids having to increase the compression facing thickness or the formation of a fluted facing. As is shown by wall members 14, 16, the purlins 36, 34 may be horizontally or vertically oriented depending upon the load design. In addition to stiffening the facings, the purlins effectively reduce the plastic creep of the insulating materials under long term loading conditions by reinforcing a large portion of the cross section of the insulation 20.

Figure 2:
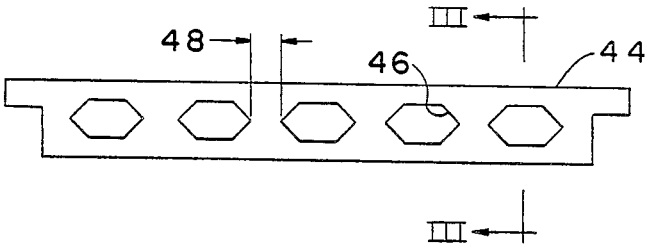
FIG. 2 shows an aperatured reinforcing member which may be employed with the structure of FIG. 1.
Figure 3:
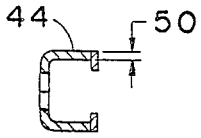
FIG. 3 shows a sectional view of the reinforcing member of FIG. 2 taken along line 3—3.

The reinforcing members 32, 34, 36, 38, 38 may have a channel cross section as shown or other structural section such as a C, I, angle, flat bar or the like. FIGS. 2 and 3 depict a particularly preferred purlin 44 having a plurality of cavities 46 with a length 48 between each of them and a transverse thickness 50. When used with a 5 inch thick panel assembly, the purlin 44 would preferably be made of 0.06 inch thick steel with $4\frac{1}{2}$ inch long cavities 46 with a $1\frac{1}{2}$ inch length 48 between them and extend about 3 to 4 inches into the foamed-in-place insulation. The cavities 46 substantially reduce the effective cross sectional area available for cold transfer through the purlin 44. They also substantially reduce the weight of the purlin 44. Further, the use of an aperatured purlin 44 facilitates the foaming step in the manufacturing process by allowing the rising foam to flow through and around the purlin 44 without rotating purlin about its bonded side. Large panels having aperatured purlins may be foamed by one shot filling.

Thus structures formed of composite sandwich panel assemblies embodying the above described invention are structurally reinforced by purlins bonded to one facing but spaced from the opposing facing. The foamed insulating material in the space between the purlin and the opposing face restricts cold flow to the outer facing so there is no condensation or unsightly condensation line on the outer facing.

While a presently preferred embodiment of the invention has been shown and described, it is to be distinctly understood that the invention is not limited thereto, but may be otherwise variously embodied within the scope of the following claims.

What is claimed is:

1. A sandwich panel assembly comprising a thickness of foamed-in-place thermal insulation disposed throughout the space between two facings and at least one reinforcing member disposed within the thermal insulation bonded to the insulation side of only one of the two facings, the member extending through at least about half of the thickness of the insulation toward and being spaced apart from the second facing with the foamed-in-place thermal insulation disposed in the space between the member and the second facing.

2. The assembly of claim 1 wherein the facing to which the reinforcing member is bonded has opposite ends and the member extends at least about half of the length between the opposite ends of the facing.

3. The assembly of claim 2 wherein the reinforcing member extends across at least 90% of the length between the opposite ends of the facing.

4. The assembly of claim 3 wherein the reinforcing member has a length which is less than the length between the opposite ends of the facing.

5. The assembly of claim 2 wherein the reinforcing member is adhesively bonded to the facing.

6. The assembly of claim 5 wherein the adhesive bonding forms a continuous layer between the reinforcing member and the facing.

7. The assembly of claim 5 wherein the reinforcing member is of channel section having a base portion between two substantially perpendicular portions and one of the perpendicular portions of the channel section is bonded to the facing.

8. The assembly of claim 7 wherein the base portion of the channel section has at least one aperture.

9. The assembly of claim 8 wherein the base portion of the channel section has a plurality of aperatures.

* * * * *